US005183964A

United States Patent [19]

Stelter et al.

[11] Patent Number: 5,183,964

[45] Date of Patent: Feb. 2, 1993

[54] TONER CHARGE CONTROL

[75] Inventors: Eric C. Stelter, Rochester; Joseph E. Guth, Holley, both of N.Y.

[73] Assignee: Eastman Kodak Company, Rochester, N.Y.

[21] Appl. No.: 816,891

[22] Filed: Jan. 3, 1992

[51] Int. Cl.[5] ..... G03G 15/06

[52] U.S. Cl. ..... 118/653; 355/259; 355/246

[58] Field of Search ..... 118/708, 712, 644, 647, 118/651, 653, 656; 355/246, 253, 259, 261-265

[56] References Cited

U.S. PATENT DOCUMENTS 4,395,112 7/1983 Miyakawa et al. .
4,521,103 6/1985 Ohtsuka et al. .
4,618,241 10/1986 Hays et al. .
4,626,096 12/1986 Ohtsuka et al. .
4,743,937 5/1988 Martin .
4,764,841 8/1988 Brewington et al. ..... 118/653 X
4,873,940 10/1989 Ishikawa et al. ..... 118/651
4,942,431 7/1990 Tada ..... 355/246
5,047,806 9/1991 Brewington et al. ..... 355/259

OTHER PUBLICATIONS

"Patent Abstracts of Japan", vol. 8, No. 271, English Abstract of Japanese Document, 59-140471, Published Dec. 12, 1984.

*Primary Examiner*—Richard L. Moses
*Attorney, Agent, or Firm*—Leonard W. Treash, Jr.

[57] ABSTRACT

In a single-component developer system, the charge of the developer is controlled despite changes in relative humidity by determining or predicting the relative humidity and adjusting the bias on a device for charging said toner, such as, a toner-adder roller or doctor blade.

6 Claims, 1 Drawing Sheet

FIG. 1
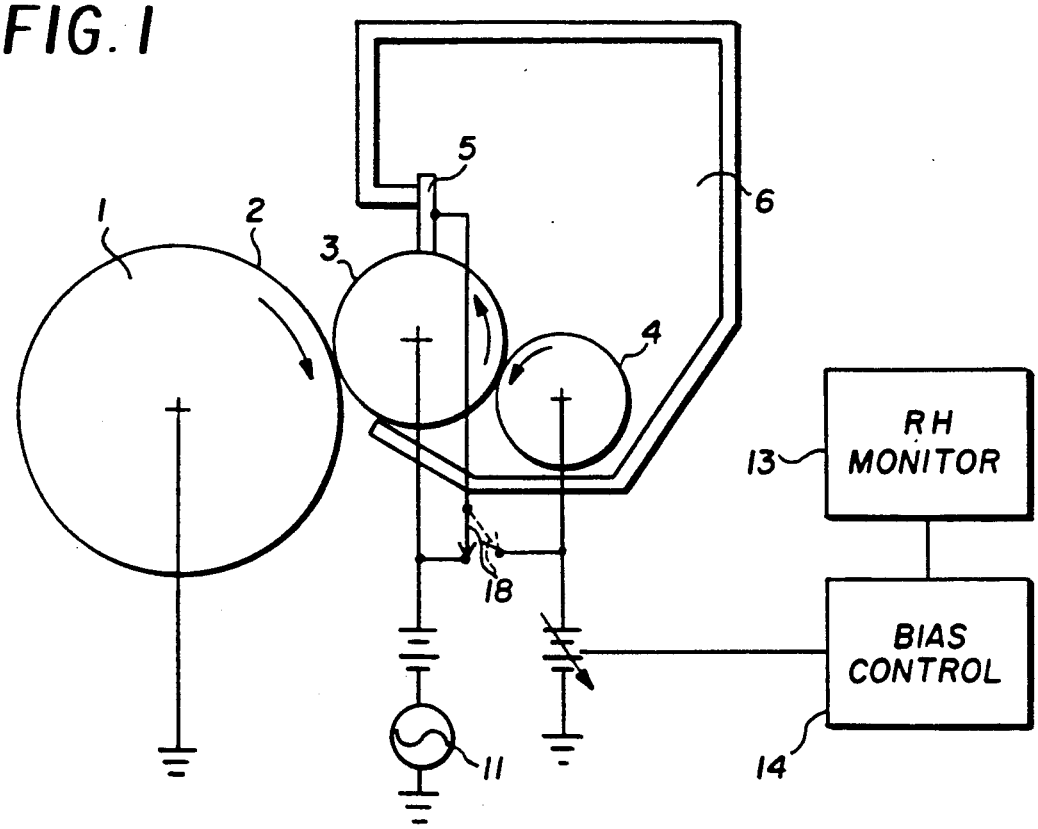
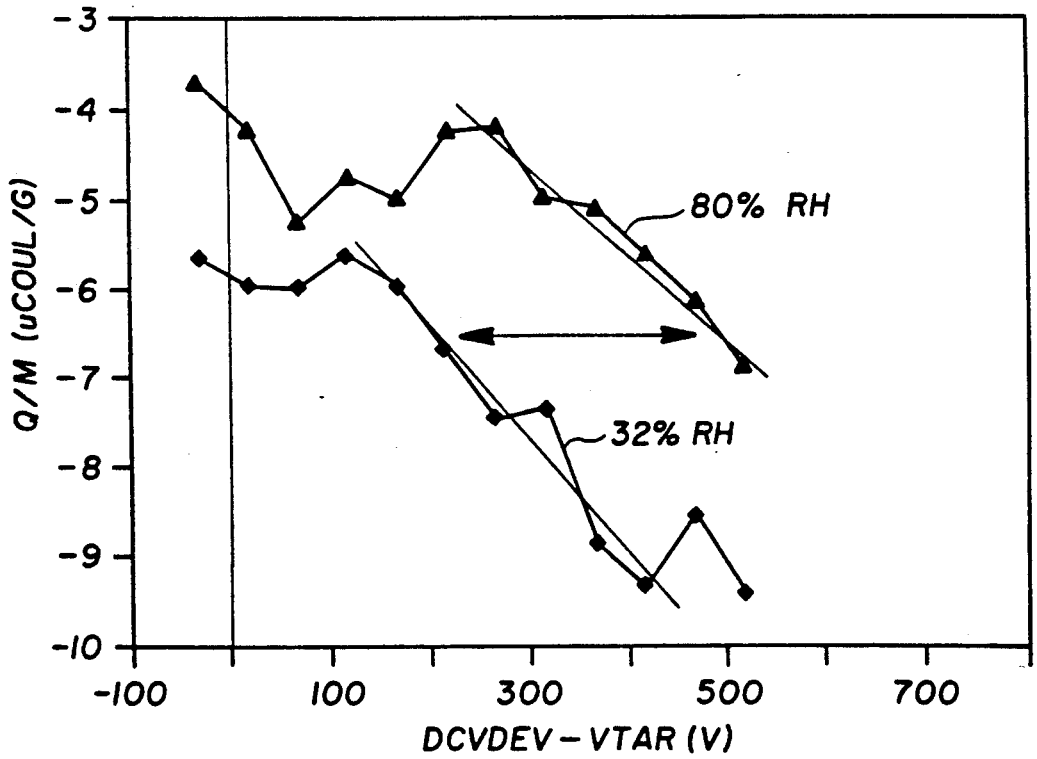
FIG. 2

TONER CHARGE CONTROL

TECHNICAL FIELD

This invention relates to the development of electrostatic images, and more specifically, to control of the charge on toner used to develop electrostatic images. It is particularly usable in the development of electrostatic images using single-component developer, that is, developers that do not include a substantial permanent carrier.

BACKGROUND OF THE INVENTION

Development of electrostatic images using a developer that does not include a carrier has become popular in low-cost printers and copiers. This system does not require a toner monitor. The rest of the mechanism for applying toner is generally less expensive than that used in two component systems. This approach provides substantial development latitude of textural subject matter but is generally not able to reproduce gray scale or continuous tones reliably.

A typical development device using single-component nonmagnetic developer includes a developer roller which is rotated to move in the same direction as an electrostatic image to be developed. A toner-adder roller both applies toner to the developer roller and charges that toner utilizing both a difference in applied potential between the toner-adder roller and the developer roller and substantial triboelectrical effect from rubbing contact between the two rollers. A doctor blade controls the thickness of the layer of developer on the developer roller and can also be used to increase or control the charge on the toner. The developer roller contacts or nearly contacts the electrostatic image bearing number while developing the image under the influence of an electric field having DC or both DC and AC components.

U.S. Pat. No. 4,873,940 Ishikawa et al, issued Oct. 17, 1989, shows a developing device using single-component magnetic toner in which transportation of the developer is assisted by a magnetic development roller but in which charging of the toner is accomplished similarly to the nonmagnetic type of system. In this system the bias between the toner-adding roller and the development roller can be switched in order to make the toner positive or negative with respect to the electrostatic image.

These systems are affected by changes in relative humidity which may account in part for their nonuse in gray scale toning applications.

U.S. Pat. No. 4,521,103 shows an attempt to compensate for problems in a single component magnetic development system by varying the bias on a developer roller with respect to the electrostatic image as a function of measured conditions, including temperature and relative humidity.

Control of the bias on the development roller with respect to the electrostatic image as a function of relative humidity can help prevent problems at one end of the exposure scale or the other depending on whether the humidity is high or low and may be an acceptable compensation in developing text material. However, such a system is still inadequate when toning "gray scale images" in which there is interest in toning potential differences across a full range of potential.

SUMMARY OF THE INVENTION

It is an object of the invention to provide better development control in electrostatic image development systems using developers having no substantial permanent carrier component.

This and other objects are accomplished by a method and apparatus of the type in which such toner is charged at least in part by the application of an electrical field. Relative humidity is sensed or otherwise determined or predicted, and the electrical field is varied as a function of the relative humidity, to control the charge on the toner under changing conditions.

According to a preferred embodiment, a single-component nonmagnetic developer is applied to a developer roller by a toner-adder roller of a conventional type. A bias between the toner-adder roller and the developer roller contributes to the charge on the toner. Relative humidity is sensed and a greater bias is applied to the toner-adder roller the higher the sensed relative humidity.

BRIEF DESCRIPTION OF THE DRAWINGS

FIG. 1 is a side schematic of a development apparatus constructed according to the invention; and FIG. 2 is a graph illustrating the variation in charge-to-mass of a single-component developer with relative humidity, as the bias is changed on a toner-adder roller in an apparatus similar to that shown in FIG. 1.

DESCRIPTION OF THE PREFERRED EMBODIMENTS

FIG. 1 illustrates a typical single-component nonmagnetic development apparatus in which an image member, for example, a photoconductive drum 1, is rotated past a series of conventional stations, not shown, to create an electrostatic image on its peripheral image surface 2. These electrostatic images are developed by a developer roller 3 which conventionally consists of a metallic core and a thin semiconductive elastomeric exterior layer. A conductive foam toner-adder roller 4 also contacts the developer roller 3. A doctor blade 5 also contacts the developer roller 3, and toner is supplied from a toner supply 6 to at least the toner-adder roller 4.

Conventionally, the toner-adder roller is rotated in a direction opposite to the direction of the developer roller at the position of contact. Toner is applied to the developer roller from the toner-adder roller. The rollers are positioned to provide substantial contact to provide some triboelectric charging to the toner as it is applied to the developer roller. The doctor blade 5 assures that a relatively thin layer, preferably one toner particle thick, approaches a development zone between the developer roller 3 and the image surface 2. The image surface 2 and the developer roller 3 are moving in the same direction in the development position, for example, with the developer roller moving somewhat faster than the image surface 2. The layer of toner on developer roller 3 develops the image by either moving across a very small gap or as the result of actual contact between the developer roller and the image surface 3.

Development between developer roller 3 and image surface 2 is assisted by an alternating current bias applied from an AC source 11 to developer roller 3. A DC component can supply whatever development bias is appropriate. For example, if discharged area development is to be used, and the electrostatic image is at 120 volts with the background at 400 volts, a typical bias on development roller 3 would be 300 to 350 volts. For charged area development, a much lower bias is appropriate, as is well known in the art.

Charge on the toner is provided by either of two mechanisms well known in the art. An electrical field created between the toner-adder roller 4 and the developer roller 3 will assist in charging the toner as will a difference in potential between the doctor blade 5 and the developer roller 3. Triboelectric charging can also be provided by either or both component's interaction with the developer roller.

Unfortunately, changes in humidity can substantially alter the charge applied to the toner by either toner-adder roller 4 or doctor blade 5. With greater charge on the toner in low humidity conditions, light laydown and thin lines will result when toning discharged areas. As the humidity increases, toner charge decreases and toner laydown increases, grays darken and lines widen, and ultimately blackground toning is produced. This can be cured by maintaining a more consistent charge-to-mass ratio of the toner than in an uncontrolled system. This is accomplished in the apparatus shown in FIG. 1 by controlling the bias on the toner-adder roller 4 or on the doctor blade 5, or both, as a function of relative humidity.

Accordingly, a relative humidity monitor 13 senses the ambient relative humidity and produces a signal proportional to it. That signal is fed to a bias control 14 which varies the bias on the toner-adder roller 4 in response to the signal. The algorithm for bias control 14 can be derived from empiric data similar to that illustrated in FIG. 2 and explained below. A switch 18 allows the bias on the toner-adder roller to also be applied to the doctor blade to assist further in control of the charge on the toner. Alternatively, the bias on the doctor blade can be used as the sole mechanism for controlling the charge on the toner.

FIG. 2 shows a plot of the charge-to-mass ratio in uCoul/g against the difference in potential between the toner-adder roller 4 and the developer roller 3 (DC component) in a system essentially the same as that shown in FIG. 1 with the doctor blade not participating in charge control. Both curves show an increase (absolute terms) in charge-to-mass, generally proportional to an increase in the difference in potential between the toner-adder roller and the developer roller. However, the charge-to-mass at 80% relative humidity is substantially less at any given difference in potential than at 32% relative humidity. The toner in question is a typical negatively charging nonmagnetic toner having a mean particle size of about 12 microns. For such systems, it is desirable to have the charge-to-mass between −6 and −7 uCoul/g. Thus, for the system illustrated in FIG. 2, the difference in potential between the toner-adder roller and the developer roller would be varied from 150 volts at 32% relative humidity to approximately 500 volts at 80% relative humidity. As will be clear to those skilled in the art, the necessary variance in bias will vary according to the toner and the materials making up the developer and toner-adder rollers. The effective charge on the toner is also dependent upon the triboelectric characteristics of the toner-adder roller and development roller as well as that of the doctor blade and developer roller. Obviously, an appropriate algorithm for adjustment of the bias must be determined empirically.

Although the system is shown and called a "single-component" developer system, the invention is usable in other systems in which the developer is more complex but does not have a substantial permanent carrier component. For purposes herein such systems will be referred to generally as single-component developer systems.

The invention has been described in detail with particular reference to a preferred embodiment thereof, but it will be understood that variations and modifications can be effected within the spirit and scope of the invention as described hereinabove and as defined in the appended claims.

We claim:

1. A method of developing electrostatic images on an image surface with toner from a toner supply, said method comprising the steps of:

rotating a toner-adder member in contact with a developer member to apply said toner to said developer member, charging said toner at least in part by applying an electric field between the toner-adder member and the developer member, and bringing such charged toner applied to the developer member into toner-applying relation with said electrostatic image to develop said image, characterized by the steps of determining or predicting the ambient relative humidity and varying said electric field as a function of such relative humidity to control the charge applied to said toner.

2. A method of developing electrostatic images carried on a moving image surface with single component nonmagnetic developer, said method comprising:

rotating a developer roller through development relation with the moving image surface, applying such developer to said developer roller by rotating a toner adder roller in rubbing contact with the developer roller, and applying an electrical field between the toner adder roller and the developer roller to help charge the developer as it is applied to the developer roller, characterized by the steps of sensing the relative humidity and varying the electrical field as a function of variations in said relative humidity to control the charge on the developer.

3. Apparatus for developing an electrostatic image on an image surface, said apparatus comprising:

a developer member movable through development relation with said electrostatic image, a toner-adder member for applying toner to said developer member, variable means for applying a bias between said toner-adder member and said developer member to apply a charge to toner being added to said developer member, means for sensing relative humidity, and means responsive to said sensing means for varying the bias between said toner-adder member and said developer member to control the charge applied to said toner despite variations in relative humidity.

4. Apparatus according to claim 3 wherein said toner-adder member is a conductive roller which engages said developer member.

5. Apparatus according to claim 4 wherein said developer member is a developer roller and said rollers are rotatable such that their peripheries move in opposite directions where engaged to triboelectrically apply charge to said toner.

6. Apparatus for developing electrostatic images on an image member, said apparatus comprising:

a developer member movable through development relation with said electrostatic image, means for applying toner to said developer member, a doctor blade engageable with toner applied to said developer member, variable means for applying a bias between said means for applying toner and said developer member to apply a charge to toner applied to said developer member, means for sensing relative humidity, and means responsive to said sensing means for varying the bias between said means for applying

* * * * *